US011731797B2

(12) United States Patent
Dyke et al.

(10) Patent No.: US 11,731,797 B2
(45) Date of Patent: Aug. 22, 2023

(54) SIDE WRAP LABELING APPARATUS

(71) Applicant: Inline Plastics Corp., Shelton, CT (US)

(72) Inventors: Joseph Dean Dyke, Stratford, CT (US); Michael Scott Janulis, Shelton, CT (US)

(73) Assignee: Inline Plastics Corp., Shelton, CT (US)

( * ) Notice: Subject to any disclaimer, the term of this patent is extended or adjusted under 35 U.S.C. 154(b) by 0 days.

(21) Appl. No.: 16/418,279

(22) Filed: May 21, 2019

(65) Prior Publication Data

US 2020/0369425 A1 Nov. 26, 2020

(51) Int. Cl.

| | |
|---|---|
| ***B65C 3/16*** | (2006.01) |
| ***B65C 9/26*** | (2006.01) |
| ***B65C 9/08*** | (2006.01) |
| ***B65C 9/04*** | (2006.01) |

(52) U.S. Cl.

CPC ..... *B65C 3/163* (2013.01); *B65C 9/04* (2013.01); *B65C 9/08* (2013.01); *B65C 9/26* (2013.01)

(58) Field of Classification Search

CPC .. B65C 3/163; B65C 9/02; B65C 9/04; B65C 9/08; B65C 9/14; B65C 9/16; B65C 9/26; B65C 9/30; B65C 9/36

See application file for complete search history.

(56) References Cited

U.S. PATENT DOCUMENTS

| | | | | |
|---|---|---|---|---|
| 3,522,134 | A * | 7/1970 | Von Hofe | B65C 9/30 156/571 |
| 4,473,429 | A * | 9/1984 | Crankshaw | B65C 3/14 156/212 |
| 4,493,744 | A | 1/1985 | Voltmer et al. | |
| 4,526,645 | A | 7/1985 | Malthouse et al. | |
| 5,021,116 | A | 6/1991 | Milgram, Jr. et al. | |
| 6,066,223 | A | 5/2000 | Gomes et al. | |
| 6,253,438 | B1 * | 7/2001 | Jespersen | B65C 9/34 225/102 |
| 6,793,755 | B2 | 9/2004 | Schaupp et al. | |
| 6,883,576 | B1 | 4/2005 | Rello et al. | |
| 6,978,819 | B2 | 12/2005 | Tanaka et al. | |
| 8,282,754 | B2 | 10/2012 | Lorence et al. | |
| 8,627,870 | B2 | 1/2014 | Leykamm | |
| 9,211,966 | B2 | 12/2015 | Broad | |

(Continued)

FOREIGN PATENT DOCUMENTS

| | | | |
|---|---|---|---|
| CN | 1865087 | A | 11/2006 |
| CN | 101293573 | A | 10/2008 |

(Continued)

OTHER PUBLICATIONS

Notaris literature: Affordable Labeler for a Broad Range of Applications, BellatRx Beyond Expectations.

(Continued)

*Primary Examiner* — George R Koch

(74) *Attorney, Agent, or Firm* — McCarter & English, LLP

(57) ABSTRACT

A container labeling apparatus having at least one label securing apparatus. The disclosed label securing apparatus may further include at least one engaging feature/element for engaging one or more surfaces of a container. The disclosed label securing apparatus is configured and adapted to facilitate adhesion of one or more labels to a surface of a container as the container is advanced past the disclosed label securing apparatus.

18 Claims, 5 Drawing Sheets

(56) References Cited

U.S. PATENT DOCUMENTS

| | | | | |
|---|---|---|---|---|
| 10,011,385 | B2 | 7/2018 | Zeljic et al. | |
| 10,106,286 | B2 | 10/2018 | Snedecor et al. | |
| 2007/0175574 | A1 | 8/2007 | Crank | |
| 2012/0061014 | A1 | 3/2012 | Patel et al. | |
| 2015/0083337 | A1* | 3/2015 | Peckham | B65C 9/12 156/378 |

FOREIGN PATENT DOCUMENTS

| | | | |
|---|---|---|---|
| CN | 101537898 | A | 9/2009 |
| CN | 201334142 | Y | 10/2009 |
| JP | 2004182487 | B2 | 7/2004 |
| JP | 2006182397 | A | 7/2006 |
| JP | 2006327628 | A | 12/2006 |
| JP | 3908828 | B2 | 1/2007 |
| JP | 3908828 | B2 | 4/2007 |
| JP | 4182487 | B2 | 11/2008 |
| WO | WO 2005/073092 | A1 | 8/2005 |
| WO | WO2005073092 | A1 | 8/2005 |
| WO | WO 2009/124228 | A1 | 10/2009 |
| WO | WO2009124228 | A1 | 10/2009 |

OTHER PUBLICATIONS

Notaris Panel Labeler Product Literature by BellatRx Inc. http://www.bellatrx.com/notaris.html Jan. 2, 2019.

* cited by examiner

SIDE WRAP LABELING APPARATUS

FIELD OF THE DISCLOSURE

The present disclosure generally relates to container labeling apparatuses and, more particularly to, automated label securing apparatuses for adhering side wrap labels to containers.

BACKGROUND OF THE DISCLOSURE

Numerous systems have been developed for applying and affixing labels to a wide variety of packages. The present systems and methods struggle with affixing a label around a side portion of a container, especially when applying the label to round containers. Specifically, prior labeling apparatus fail to sufficiently adhere the edges of the label to a curved surface of the container to inhibit the label from prematurely peeling off the surface of the container. This problem is especially exasperated when the label is large and is intended to wrap or extend nearly 180 degrees around the circumference of the container. Moreover, many prior labeling apparatuses are expensive and require numerous sensing and timing elements and complex control logic.

Based on the foregoing, a need exists for cost effective and simple systems and methods for adhering a side wrap label to a container, especially a round container, that are capable of engaging and affixing the outer edges of the label. Thus, an interest exists for an improved label securing apparatus and related methods of using the same. The aforementioned inefficiencies and opportunities for improvement are addressed and/or overcome by the assemblies, systems and methods of the present disclosure.

SUMMARY OF THE DISCLOSURE

The present disclosure provides a container labeling apparatus. More specifically, disclosed is a container labeling apparatus adapted and configured for applying labels to the side of a rounded container.

The exemplary embodiments disclosed herein are illustrative of a container labeling apparatus defining an input end and an output end. Particularly, a container labeling apparatus having a label securing apparatus (e.g., side wrap labeling apparatus). The container labeling apparatus may include a plurality of label securing apparatuses. The disclosed label securing apparatus may further include an engaging feature/element (e.g., container engaging feature/element). The disclosed label securing apparatus may include a plurality of engaging features/elements (e.g., container engaging features/elements). The disclosed label securing apparatus may define a longitudinal axis. The disclosed label securing apparatus may be at least partially rotatable. The disclosed container labeling apparatus may further include at least one container moving element (e.g., conveyor) for moving at least one container from at least a first position to a second position.

The disclosed label securing apparatus may, in part, define one or more shapes (e.g., sphere, cylinder, cone, cube, tetrahedron, triangular prism, pentagonal prism, hexagonal prism, octagonal prism, star prism, and any combination thereof). In some embodiments, the disclosed label securing apparatus and the at least one container engaging feature/element may, in part, define one or more shapes (e.g., sphere, cylinder, cone, cube, tetrahedron, triangular prism, pentagonal prism, hexagonal prism, octagonal prism, star prism, and any combination thereof).

The disclosed container engaging feature/element may, in part, be associated with at least a portion of an exterior of the disclosed label securing apparatus. The disclosed container engaging feature/element (e.g., cavity) may, in part, extend inwardly towards the longitudinal axis from an exterior surface of the disclosed label securing apparatus. In some embodiments, a plurality of the disclosed container engaging features/elements (e.g., cavities) may, in part, extend inwardly towards the longitudinal axis from an exterior surface of the disclosed label securing apparatus. The disclosed container engaging feature/element may be fabricated with or assembled to the disclosed label securing apparatus. The disclosed cavity may, in part, define one or more shapes (e.g., sphere, cylinder, cone, cube, tetrahedron, triangular prism, pentagonal prism, hexagonal prism, octagonal prism, star prism, and any combination thereof). Particularly, the disclosed cavity may, in part, define one or more partial shapes (e.g., a semi-sphere, cylinder, cone, cube, tetrahedron, triangular prism, pentagonal prism, hexagonal prism, octagonal prism, star prism, and any combination thereof).

The disclosed container engaging feature/element may be configured and adapted to at least partially interface with at least one container. The at least one container may be fabricated from a variety of materials (e.g., plastic, glass, metal, ceramic). The disclosed plurality of container engaging features/elements may be configured and adapted to at least partially interface with a plurality of containers. In an exemplary embodiment, the disclosed container engaging feature/element may be configured and adapted to at least partially interface with a corresponding container. The disclosed container engaging feature/element may be configured and dimensioned to at least partially receive at least one container. The disclosed container engaging feature/element may be configured to interface with about half of a surface of the at least one container. The disclosed container engaging feature/element may be configured to interface with less than or equal to about 180 degrees of a surface of the at least one container. Particularly, the disclosed container engaging feature/element may be configured to interface with less than or equal to about 160 degrees of a surface of the at least one container. It is appreciated that the container may at least partially rotate when interfaced with the disclosed container engaging feature/element such that the disclosed container engaging feature/element interfaces with more than 180 degrees of a surface of the container.

It should be understood, however, that although the disclosed container engaging feature/element may be configured and adapted to interface with less than or equal to about 180 degrees of a surface of the container, the engagement may or may not be simultaneous. It is appreciated that the container may at least partially rotate when interfaced with the disclosed container engaging feature/element such that only a portion of the disclosed container engaging feature/element is interfacing with the container at a given time. Furthermore, it is appreciated that the container may be moving (e.g., translating) relative to the disclosed label securing apparatus and/or the disclosed container engaging feature/element such that only a portion of the disclosed container engaging feature/element interfaces with the container at a given time. Accordingly, the degree to which the disclosed container engaging feature/element interfaces with the container may vary based, in part, on the positioning of the at least one container relative to the disclosed label securing apparatus and/or the disclosed container engaging feature/element.

The disclosed label securing apparatus and/or the disclosed container engaging feature/element may be configured and adapted to interface with at least a portion of a label positioned, in part, on a surface of the container. In an exemplary embodiment, a label may, in part, be positioned on a surface of the container, the label may be applied from a portion of the container labeling apparatus. The container may be positioned so that at least a portion of the label, positioned on a surface of the container, interfaces with at least a portion of the disclosed label securing apparatus. The disclosed label securing apparatus may capture at least a portion of the label to at least partially apply the label to the surface of the container. In some embodiments, the disclosed container engaging feature/element may capture at least a portion of the label to at least partially apply the label to the surface of the container.

In another exemplary embodiment, the container labeling apparatus may include a container positioned on a container moving element for advancement from at least a first position to a second position. A label may, in part, be positioned on a surface of the container, the label may be applied prior to, at, or after the first position or the second position. The container may interface with the disclosed label securing apparatus so as to facilitate adherence of the label to the surface of the container. Particularly, the container may be advanced by the disclosed container moving element to interface with the disclosed container engaging feature/element of the disclosed label securing apparatus so as to facilitate adherence of the label to the surface of the container. The disclosed container may be advanced a predetermined distance between an input end and an output end of the disclosed container labeling apparatus. The disclosed container engaging feature/element may capture at least a portion of the label (e.g., an edge of the label) so as to adhere the label to the surface of the container. In some instances, the disclosed container engaging feature/element of the disclosed label securing apparatus may interface with at least a portion of a first edge of the label, at least a portion of a second edge of the label and at least a portion of the label positioned therebetween. The first edge of the label and the second edge of the label are oppositely positioned from each other.

In some embodiments, as the container translates towards and/or past the disclosed label securing apparatus, the disclosed container engaging feature/element may capture at least a portion of the container. The disclosed label securing apparatus, being at least partially rotatable, may rotate as the container translates tangentially past the disclosed label securing apparatus. In some instances, the disclosed container engaging feature/element of the disclosed label securing apparatus may capture at least a portion of the container and engage with at least a portion of the first edge of the label. As the container translates past the disclosed label securing apparatus, the disclosed container engaging feature/element may rotate consistent with the translation of the container. During the rotation, the disclosed container engaging feature/element may engage with at least a portion of the second edge of the label. During rotation, the disclosed container engaging feature/element may engage with at least a portion of the label positioned between the first edge and the second edge. At least partially engaging the label, including at least the first edge and the second edge, may facilitate better label adhesion to the surface of the container.

In some instances, the label may be partially adhered prior to engagement with the disclosed label securing apparatus. For example, a gas (e.g., air) may be blown against at least a portion of the label to partially adhere the label to a surface of the container.

In some embodiments, the disclosed label securing apparatus and/or the disclosed container engaging feature/element may, in part, maintain the desired orientation of the container or alter the orientation of the container to be place in a desired orientation. In a non-limiting example, maintaining the desired orientation of the container or altering the orientation of the container to be placed in the desired orientation may, in part, ensure repeatable label adherence in the preferred location on the container and/or facilitate consistent packaging of the containers. In some embodiments, the container having one or more tear strips may be positioned on the disclosed container moving element in a desired orientation and translating to at least partially engage with the disclosed label securing apparatus. The container may maintain its desired orientation upon disengagement with the disclosed label securing apparatus. In other embodiments, the container having one or more tear strips may be positioned on the disclosed container moving element in an undesired orientation and translating to at least partially engage with the disclosed label securing apparatus. The container may, upon disengagement with the disclosed label securing apparatus, be positioned in a desired orientation. The disclosed label securing apparatus may, in part, alter the orientation of the container to achieve the desired orientation.

The disclosed label securing apparatus may be configured to self-align after engagement with a container. Particularly, the disclosed label securing apparatus may be configured to self-align such that after the disclosed container engaging feature/element engages with a first container, the disclosed container engaging feature/element is positioned to engage with a second container. Instances where the disclosed label securing apparatus includes at least two container engaging features/elements, the disclosed label securing apparatus may rotate sufficiently to prepare the second container engaging feature/element to engage with a second container. The act of rotating the disclosed label securing apparatus to ready the disclosed container engaging feature/element to engage with a corresponding container may be referred to as coordinating the disclosed label securing apparatus.

In another exemplary embodiment, the disclosed side wrap labeling machine may include a container transport system for moving at least one container from an input end of the apparatus to an output end, a label dispensing apparatus which places at least one label on a side of each container traversing the container transport system, and a rotatable label securing apparatus which includes at least one container engaging feature/element having a surface which is shaped to correspond with the side of the container. The rotatable label securing apparatus may be configured to secure the container and label as they traverse the container transport system and to affix the label to the container.

In some instances, the rotatable label securing apparatus may include four container engaging features/elements, defining a star wheel configuration. The at least one container engaging feature/element may define a curved surface that may be dimensioned to secure a similarly dimensioned container. The rotatable label securing apparatus may be configured to secure up to a 180 degree label. The disclosed container labeling apparatus may further include a second rotatable label securing apparatus having at least one container engaging feature/element. The second rotatable label securing apparatus may be oppositely positioned from the first rotatable label securing apparatus and is configured to secure a second label. The first rotatable labeling securing apparatus and the second rotatable label securing apparatus may rotate independently of each other or dependently of each other.

In some instances, the rotatable label securing apparatus is configured to self-align. Specifically, the rotatable label securing apparatus may secure a first container traversing the container transport system and then self-align in order to secure a second container traversing the container transport system a distance behind the first container. The container may be positioned in contact with at least one conveyor belt, included with the container transport system.

In another exemplary embodiment, a method of affixing a label to a container may include (i) transporting at least one container on a container transport system from an input end of a container labeling apparatus to an output end; (ii) placing at least one label dispensed from a label dispensing apparatus on a side of each container traversing the container transport system; and (iii) affixing the at least one label on the side of each container traversing the container transport system using a rotatable label securing apparatus. The rotatable label securing apparatus may include at least one container engaging feature/element having a surface which is shaped to correspond with the side of the container.

In some instances, the rotatable label securing apparatus may be configured to self-align. Specifically, the rotatable label securing apparatus may secure a first container traversing the container transport system and then self-align in order to secure a second container traversing the container transport system a distance behind the first container. The container may traverse the container transport system tangential to the rotatable label securing apparatus. The rotatable label securing apparatus may be configured to rotate relative to a speed of the container traversing the container transport system. The rotatable label securing apparatus may be configured for passive movement.

In some instances, the container labeling apparatus may include a second rotatable label securing apparatus having at least one container engaging feature/element. The second rotatable label securing apparatus may be oppositely positioned from the first rotatable securing apparatus. The first rotatable label securing apparatus and the second rotatable label securing apparatus may be configured to secure two labels to the side of the container. The first rotatable label securing apparatus and the second rotatable label securing apparatus may rotate independently of each other.

Any combination or permutation of features, functions and/or embodiments as disclosed herein is envisioned. Additional advantageous features, functions and applications of the disclosed systems, methods and assemblies of the present disclosure will be apparent from the description which follows, particularly when read in conjunction with the appended figures. All references listed in this disclosure are hereby incorporated by reference in their entireties.

BRIEF DESCRIPTION OF DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various features, steps and combinations of features/steps described below and illustrated in the figures can be arranged and organized differently to result in embodiments which are still within the scope of the present disclosure.

Figure 1:
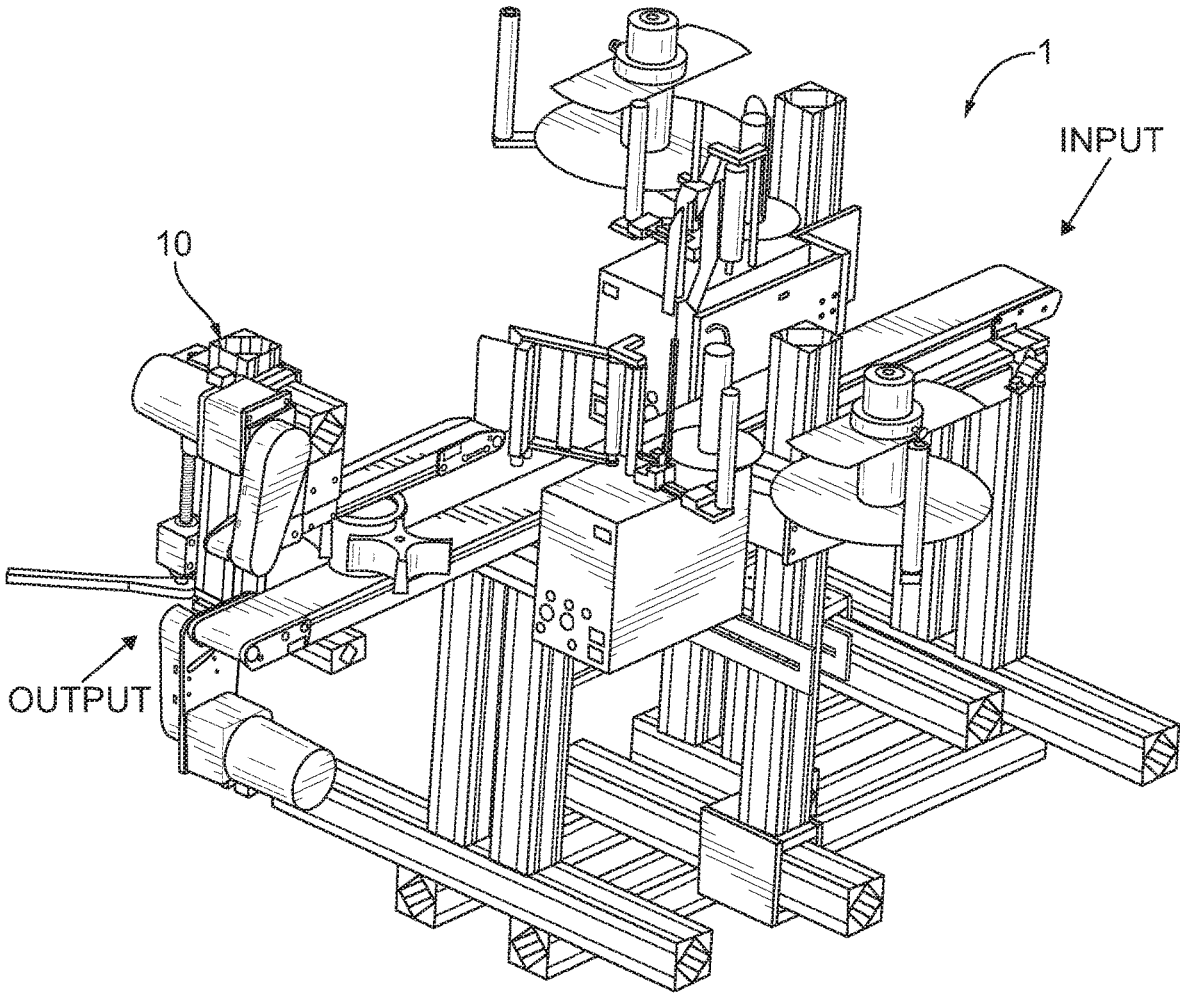
Figure 2:
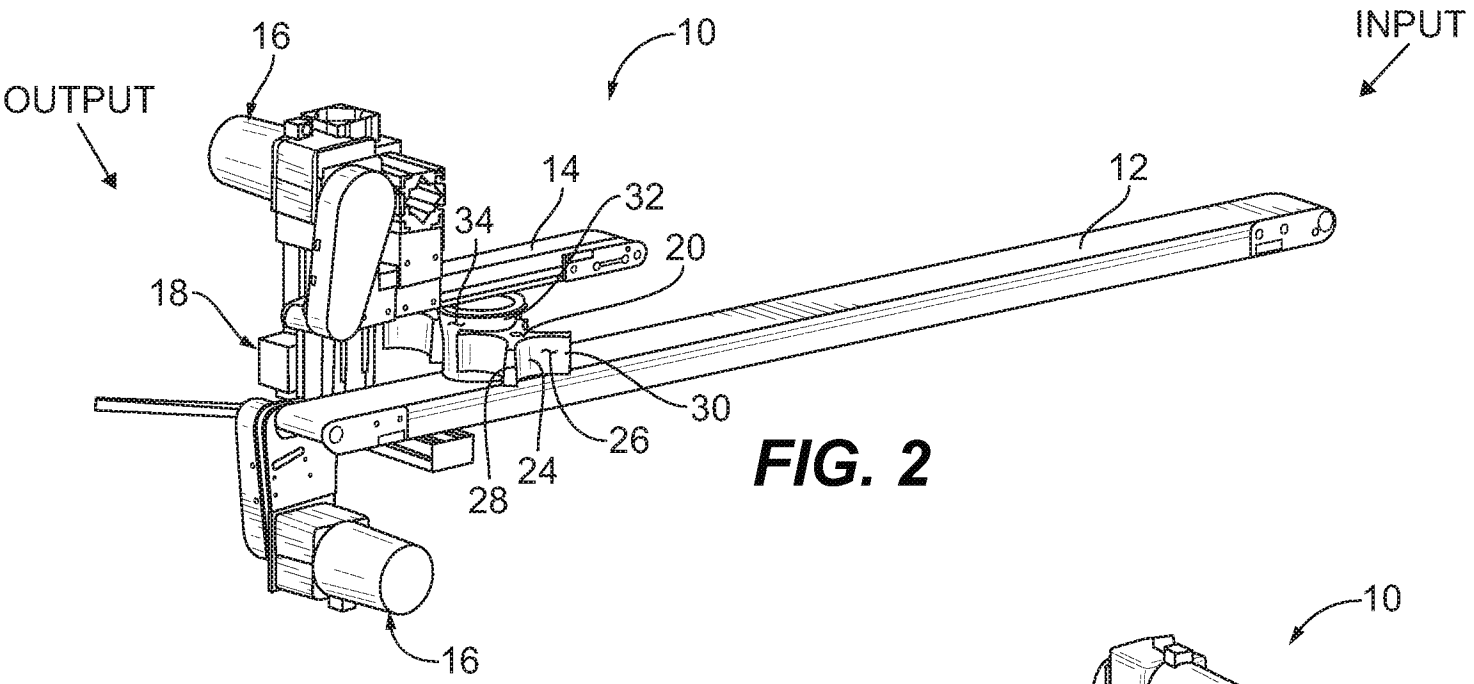
Figure 3:
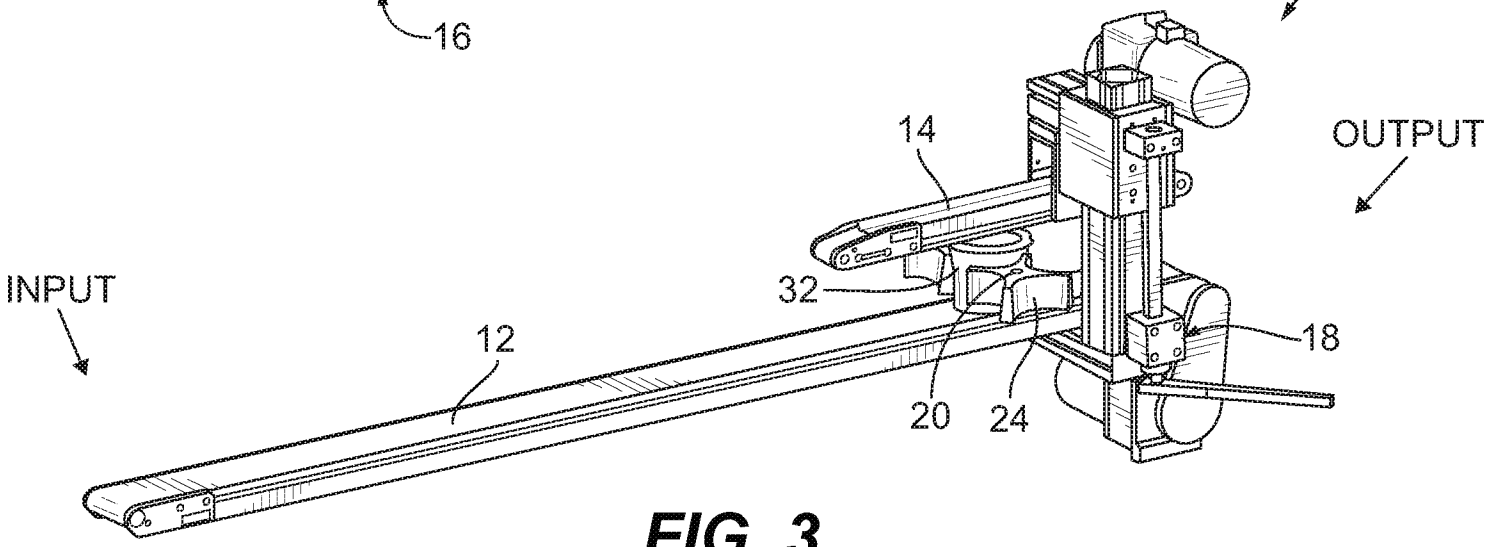
Figure 4:
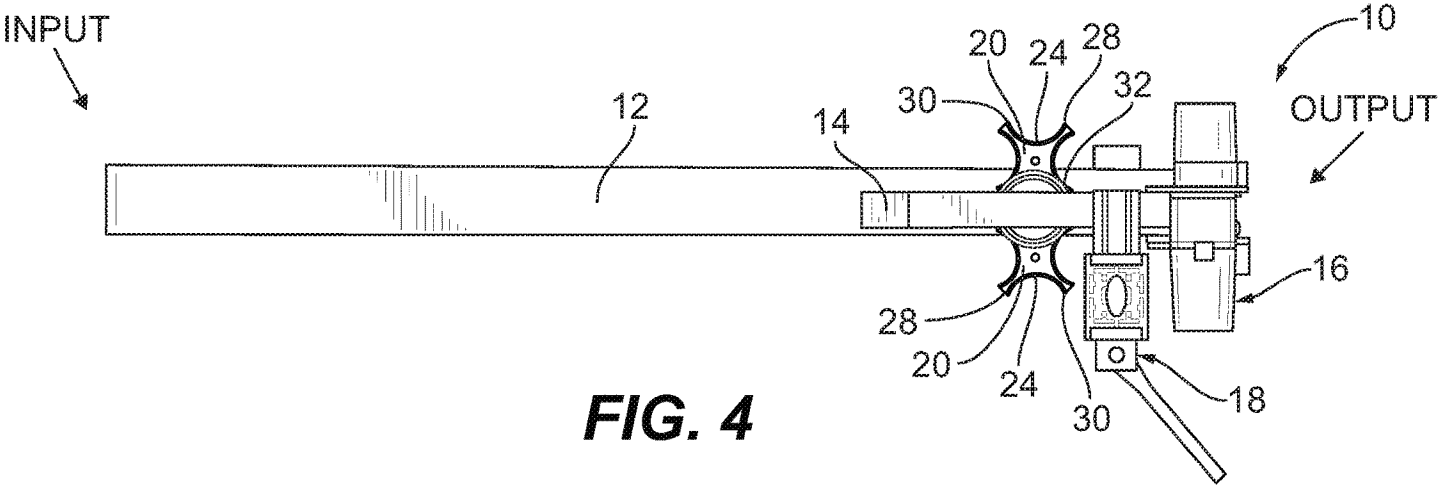
Figure 5:
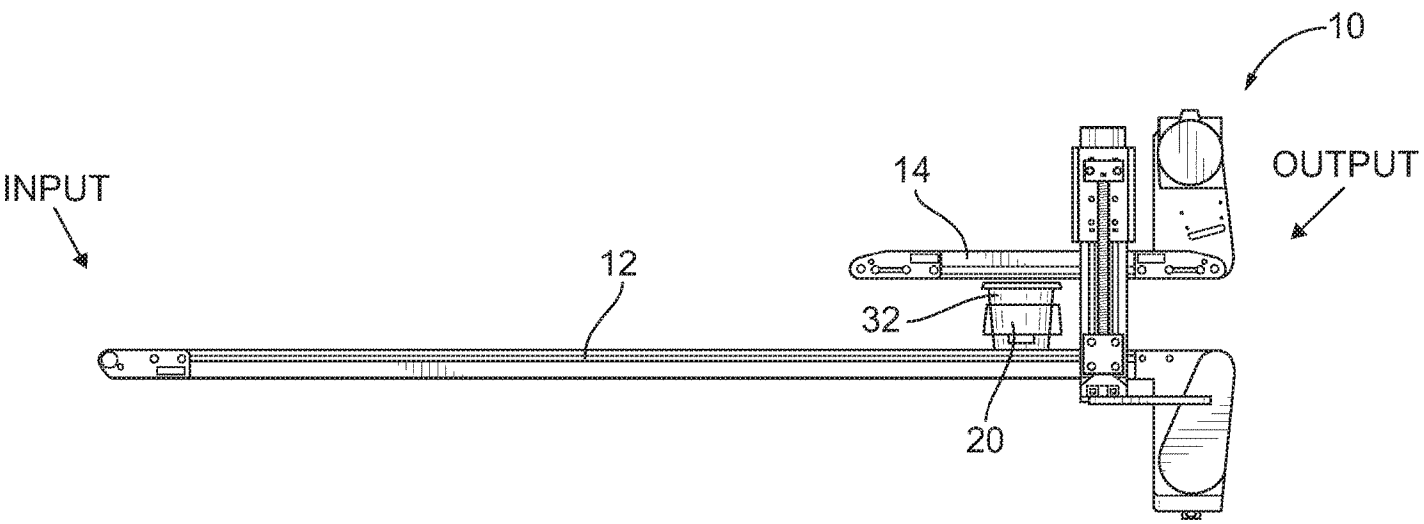
Figure 6:
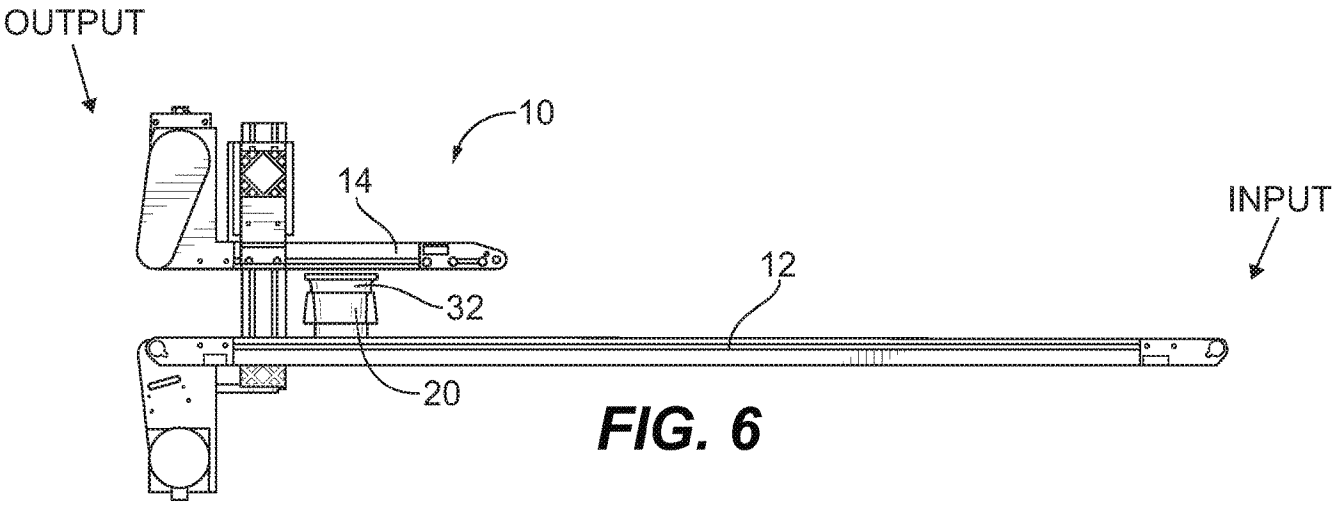
Figure 7:
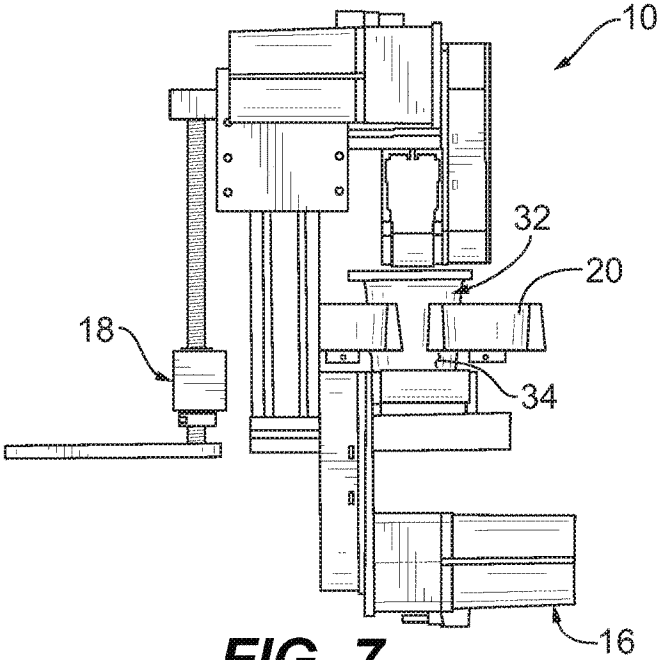
Figure 8:
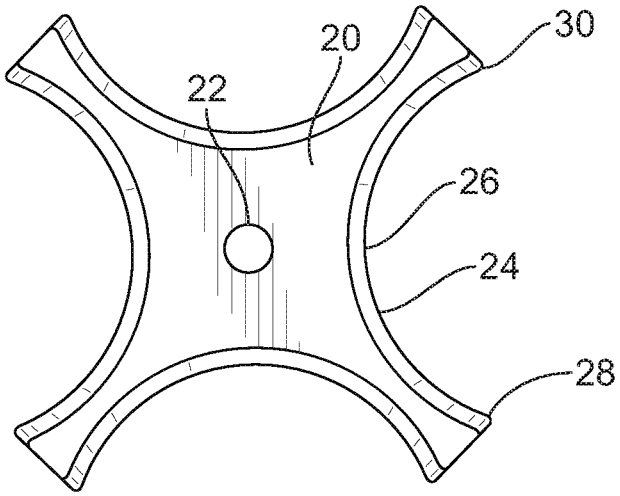
Figure 9:
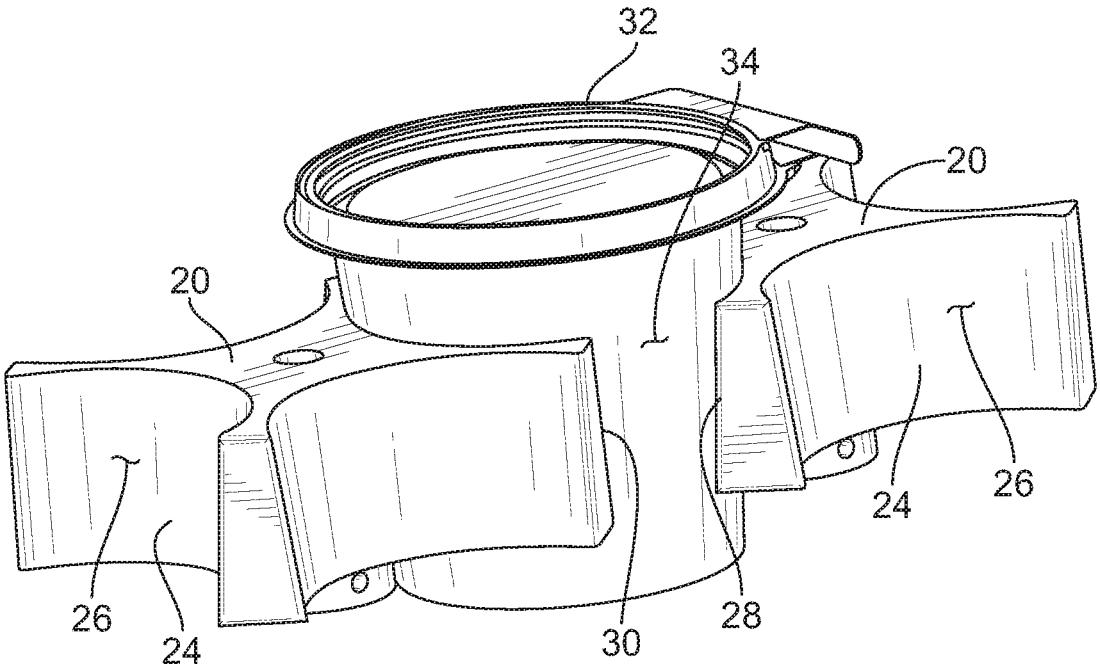

To assist those of ordinary skill in the art in making and using the disclosed assemblies, systems and methods, reference is made to the appended figures, wherein:

FIG. 1 depicts a perspective view of a side wrap labeling machine which has been constructed in accordance with an embodiment of the present disclosure;

FIG. 2 depicts a perspective view of a portion of the side wrap labeling machine taken from the container output side of the machine;

FIG. 3 depicts a perspective view of a portion of the side wrap labeling machine taken from the container input side of the machine;

FIG. 4 depicts a top plan view of a portion of the side wrap labeling machine;

FIG. 5 depicts a side elevation view of a portion of the side wrap labeling machine;

FIG. 6 depicts a side elevation view of a portion of the side wrap labeling machine;

FIG. 7 depicts a rear elevation view of a portion of the side wrap labeling machine;

FIG. 8 depicts a top view of an advantageous label securing apparatus according to the present disclosure; and FIG. 9 depicts a perspective view of two advantageous label securing apparatuses and a container positioned therebetween, according to the present disclosure.

DETAILED DESCRIPTION OF DISCLOSURE

In the following description, it is understood that terms such as "top," "bottom," "outward," "inward," "internal," "external," and the like are words of convenience and are not to be construed as limiting terms. Reference will be made in detail to exemplary embodiments of the disclosure, which are illustrated in the accompanying figures and examples. Referring to the drawings in general, it will be understood that the illustrations are for the purpose of describing particular embodiments of the disclosure and are not intended to limit the same.

Referring now to the drawings, wherein like parts are marked throughout the specification and drawings with the same or similar reference numerals. Drawing figures are not necessarily to scale and in certain views, parts may have been exaggerated for purposes of clarity.

FIG. 1 depicts side wrap labeling machine 1, which includes, in part, container labeling apparatus 10. As further depicted in FIGS. 1-7, container labeling apparatus 10 includes at least one container moving element/container transport system (e.g., conveyor) 12. Container labeling apparatus 10 may further define an input end and an output end. Container labeling apparatus 10 may further include an upper container moving element (e.g., conveyor) 14 positioned above conveyor 12. Conveyors 12, 14 may be configured to directly/indirectly interface with one or more containers 32. One or more containers 32 may be positioned at least partially in contact with one or both conveyors 12, 14. For ease of disclosure, conveyor 12 (e.g., bottom conveyor) may be positioned below conveyor 14 (e.g., top conveyor) such that conveyor 12 is configured to interface with a bottom portion of container 32. In some instances, bottom conveyor 12 and top conveyor 14 may be referred to collectively as conveyor (or conveyors) 12, 14, unless otherwise stated. Conveyors 12, 14 may extend a predetermined distance between the input end and the output end. Container(s) 32 may translate between an input end and an output end of container labeling apparatus 10.

Conveyors 12, 14 may be at least partially coupled to at least one conveyor moving system 16. In some embodiments, bottom conveyor 12 may be at least partially coupled to a first conveyor moving system 16 and top conveyor 14 may be at least partially coupled to a second conveyor moving system 16. Conveyor 12, 14 may be at least partially actuated by at least one conveyor moving systems 16. Conveyor moving system 16 may be a motor at least partially coupled to conveyor 12, 14. Conveyor moving system 16 may adjustably control conveyor 12, 14.

Conveyor 12 and/or conveyor 14 may be coupled to adjustment mechanism 18. In an exemplary embodiment, top conveyor 14 may be coupled to adjustment mechanism 18. Adjustment mechanism 18 may be configured and adapted to adjust one or more positions of top conveyor 14 with respect to container 32 and/or bottom conveyor 12. For example, adjustment mechanism 18 may be configured and adapted to increase/decrease the distance between top conveyor 14 and bottom conveyor 12.

Container labeling apparatus 10 may further include at least one label securing apparatus 20, as further depicted in FIGS. 8 and 9. FIG. 8 depicts a top view of label securing apparatus 20 and FIG. 9 depicts a perspective view of two label securing apparatuses 20 positioned relative to container 32. In some embodiments, container labeling apparatus 10 may include one label securing apparatus 20. In other embodiments, container labeling apparatus 10 may include at least two label securing apparatuses 20. Label securing apparatus 20 may define a longitudinal axis. Label securing apparatus 20 may be at least partially rotatable around the longitudinal axis. Label securing apparatus 20 may be at least partially rotated around centrally located feature/element (e.g., rod, pin, post) 22. Rotational feature/element 22 may be axially positioned with respect to the longitudinal axis of label securing apparatus 20. Label securing apparatus 20 may, in part, define one or more shapes (e.g., sphere, cylinder, cone, cube, tetrahedron, triangular prism, pentagonal prism, hexagonal prism, octagonal prism, star prism, and any combination thereof).

Label securing apparatus 20 may further include engaging feature/element (e.g., container engaging feature/element) 24. Label securing apparatus 20 may include a plurality of engaging features/elements (e.g., container engaging features/elements) 24. In some embodiments, label securing apparatus 20 and the at least one container engaging feature/element 24 may, in part, define one or more shapes (e.g., sphere, cylinder, cone, cube, tetrahedron, triangular prism, pentagonal prism, hexagonal prism, octagonal prism, star prism, and any combination thereof).

In an exemplary embodiment, label securing apparatus 20 and the at least one container engaging feature/element 24 may, in part, define a star prism (e.g., star wheel). Particularly, label securing apparatus 20 and four container engaging features/elements 24 may, in part, define a star wheel. Container engaging feature/element 24 may be defined, in part, as semi-cylindrical. However, it is appreciated that label securing apparatus 20 may include more or less container engaging features/elements 24.

Container engaging feature/element 24 may, in part, be associated with (e.g., extend from) at least a portion of an exterior of label securing apparatus 20. In other cases, container engaging feature/element 24 may, in part, form at least a portion of the exterior of label securing apparatus 20. Container engaging feature/element (e.g., cavity) 24 may, in part, extend inwardly towards the longitudinal axis from an exterior surface of label securing apparatus 20. In some embodiments, a plurality of container engaging features/elements (e.g., cavities) 24 may, in part, extend inwardly towards the longitudinal axis from an exterior surface (or edge 28, 30) of label securing apparatus 20.

Container engaging feature/element 24 may be at least partially concave (semi-cylindrical). At least partially concave surface 26 may further define at least one edge. Container engaging feature/element 24 may define at least two upright edges 28, 30. Upright edges 28, 30 may be substantially parallel with the longitudinal axis of label securing apparatus 20. Container engaging feature/element 24 may be configured and adapted to at least partially interface with at least one container. The distance between first edge 28 and second edge 30 may vary depending on the dimensions of container 32. Surface 26 may be substantially parallel to upright edges 28, 30 or may be angled with respect to upright edges 28, 30. Surface 26 may be parallel or angled to correspond to outside surface 34 of container 32.

In an exemplary embodiment, container engaging feature/element 24 may be configured and adapted to at least partially interface with a corresponding container 32. Container engaging feature/element 24 may be configured to interface with less than or equal to about 180 degrees of surface 34 of container 32. Particularly, container engaging feature/element 24 may be configured to interface with less than or equal to about 160 degrees of surface 34 of container 32. Container engaging feature/element 24 may be configured and adapted to at least partially interface with at least one container 32 having at least one label. For example, container engaging feature/element 24 may be configured and adapted to interface with surface 34 of container 32 having at least one label (e.g., at least one side wrap label) at least partially adhered thereto. First edge 28 and second edge 30 may be configured to at least partially interface with the at least one label. For example, first edge 28 and second edge 30 may be configured to at least partially interface with one or more edges of an at least one label. The height of container engaging feature/element 24 may be dimensioned to engage with the at least one label. For example, the height of container engaging feature/element 24 may be the size of or larger than the at least one label.

Label securing apparatus 20 may be positioned in close proximity to bottom conveyor 12, top conveyor 14, or bottom conveyor 12 and top conveyor 14. In an exemplary embodiment, label securing apparatus 20 may be adjustably positioned with respect to bottom conveyor 12, top conveyor 14, or bottom conveyor 12 and top conveyor 14. For example, label securing apparatus 20 may be adjusted such that the longitudinal axis may intersect a portion of bottom conveyor 12, top conveyor 14, or bottom conveyor 12 and top conveyor 14. In another example, label securing apparatus 20 may be adjusted such that the longitudinal axis does not intersect a portion of bottom conveyor 12, top conveyor 14, or bottom conveyor 12 and top conveyor 14.

In some embodiments, at least two label securing apparatuses 20 may be positioned in close proximity to bottom conveyor 12, top conveyor 14, or bottom conveyor 12 and top conveyor 14. The at least two label securing apparatuses 20 may be adjustably positioned with respect to each other, bottom conveyor 12, top conveyor 14, and any combination thereof. The at least two label securing apparatuses 20 may be oppositely positioned. The two label securing apparatuses 20 may be oppositely positioned a predetermined distance from each other. The two label securing apparatuses 20 may be adjustable. The two label securing apparatuses 20 may be aligned and may be oppositely positioned on either side of conveyors 12, 14.

In other embodiments, one label securing apparatus 20 may be positioned in close proximity to bottom conveyor 12, top conveyor 14, or bottom conveyor 12 and top conveyor 14. Label securing apparatus 20 may be adjustably positioned with respect to bottom conveyor 12, top conveyor 14, and any combination thereof. Label securing apparatus 20 may be positioned in close proximity to a semi-permanent element (e.g., peeler plate). The disclosed at least partially fixed element may be in close proximity to one or more container engaging feature/element 24. For example, the disclosed semi-permanent element may be tangential to label securing apparatus 20 (e.g., container engaging feature/element 24, container 32 at least partially received by container engaging feature/element 24). The disclosed semi-permanent element may be adjustable. The disclosed semi-permanent element may assist with the application of one or more labels (e.g., side wrap labels).

In an exemplary embodiment (e.g., FIGS. 4, 7 and 9), container labeling apparatus 10 may include at least two label securing apparatuses 20 (e.g., star wheels). Container labeling apparatus 10 may include container 32 positioned with respect to bottom conveyor 12 and top conveyor 14. A bottom surface of container 32 may be positioned directly/indirectly in contact with bottom conveyor 12 and a top surface of container 32 may be positioned directly/indirectly in contact with top conveyor 14. Conveyor 12, 14 may be configured and adapted to advance (e.g., translate) container 30 from at least a first position to a second position. A label may, in part, be positioned on surface 34 of container 32. The label may be applied, in part, prior to, at, or after the first position or the second position.

In a non-limiting example, container 32 is directly/indirectly positioned on bottom conveyor 12, which is configured and adapted to translate container 32 between various positions (e.g., a predetermined distance between input end and output end). Container 32 is positioned on bottom conveyor 12 in a predetermined orientation. For example, if container 32 includes one or more features, the one or more features may be used to determine the desired orientation. Particularly, container 32 may include a tear strip; the tear strip may be used to determined the preferred orientation. Side wrap labeling machine 1 includes one or more label dispensing apparatus(es) (e.g., label head), which is/are configured and adapted to feed at least one label per container 32. As container 32, positioned on bottom conveyor 12, passes by (or through) the label head (not shown), the label head feeds the label at a speed comparable to the translational speed of container 32. The label may be at least partially adhered to surface 34 of container 32. The label may be at least partially adhered to surface 34 of container 32 while container 32 is translated by bottom conveyor 12 between an input end and an output end. A gas (e.g., air) may be blown on the label to promote at least partial adherence to surface 34. Thus, each label is repeatably adhered to the appropriate location based on the desired orientation of each container 32.

Positioned a predetermined distance from the label head is the at least one label securing apparatus (e.g., side wrap labeling apparatus) 20. Positioned a predetermined distance from the label head are the two label securing apparatuses 20. Label securing apparatus 20 is configured and adapted to facilitate adherence of the label to surface 34 of container 32. Particularly, container 32 may be advanced by bottom conveyor 12 to interface with container engaging feature/element 24 of label securing apparatus 20 so as to facilitate adherence of the label to surface 34 of container 32. Label securing apparatus 20 may at least partially engage with container 32 in a manner so as to not interrupt the continuous movement of container 32 by conveyor 12, 14. Label securing apparatus 20 may be positioned substantially tangential to the path of travel of container 32. A semi-permanent element (e.g., peeler plate) may further be included in close relation to (e.g., tangential to) the at least one label securing apparatus 20 so as to facilitate adherence of the label to surface 34 of container 32.

In some instances, as container 32 translates towards and/or past label securing apparatus 20 (e.g., tangential to), container engaging feature/element 24 may at least partially engage and/or capture at least a portion of container 32. At least one label securing apparatus 20 and the at least one semi-permanent element (e.g., peeler plate) may at least partially interface with container 32 concurrently. At least two oppositely position label securing apparatuses 20 may at least partially engage container 32 concurrently. The two oppositely positioned label securing apparatuses 20 may facilitate adherence of two labels (e.g., side labels). Label securing apparatus 20, being at least partially rotatable, may rotate as container 32 translates substantially tangential to label securing apparatus 20. In some instances, container engaging feature/element 24 of label securing apparatus 20 may capture at least a portion of container 32 having at least one label (e.g., side label). The label defines a first edge and a second edge, wherein the first edge may be the leading edge. Particularly, container engaging feature/element 24 may engage with at least a portion of the first edge of the label. Even more particularly, first edge 28 of container engaging feature/element 24 may engage with at least a portion of the first edge of the label. As container 32 translates substantially tangential to label securing apparatus 20, container engaging feature/element 24, already at least partially engaged with the first edge of the label, may rotate consistent with the translation of container 32. During the rotation, container engaging feature/element 24 may engage with at least a portion of the second edge of the label. During the rotation, second edge 30 of container engaging feature/element 24 may engage with at least a portion of the second edge of the label. During rotation, container engaging feature/element 24 may further engage with at least a portion of the label positioned between the first edge and the second edge. During rotation, at least partially concave surface 26 of container engaging feature/element 24 may further engage with at least a portion of the label positioned between the first edge and the second edge. The above technique may be repeated concurrently by a second label securing apparatus 20 to facilitate adherence of a second label. At least partially engaging the label, including at least the first edge and the second edge, helps to promote sufficient label adhesion to surface 34 of container 32.

In instances where container 32 is substantially cylindrical, container engaging feature/element (e.g., semi-cylindrical) 24 of a first label securing apparatus 20 may at least partially engage with less than or equal to 180 degrees of surface 34 of container 32, consistent with the technique outlined above. In some instances, container engaging feature/element (e.g., semi-cylindrical) 24 of a second label securing apparatus 20 may at least partially engage with less than or equal to the remaining 180 degrees of surface 34 of container 32, consistent with the technique outlined above. In instances where container 32 is substantially cylindrical, container engaging feature/element (e.g., semi-cylindrical) 24 of a first label securing apparatus 20 may at least partially engage with less than or equal to 160 degrees of surface 34 of container 32, consistent with the technique outlined above. In some instances, container engaging feature/element (e.g., semi-cylindrical) 24 of a second label securing apparatus 20 may at least partially engage with less than or equal to an additional 160 degrees of surface 34 of container 32, consistent with the technique outlined above. It is appreciated that the first label securing apparatus 20 and the second label securing apparatus 20 may not at least partially engage with container 32 concurrently. It is also appreciated that one label securing apparatus 20 may be used to apply one or more labels. It is also appreciated that the first or second label securing apparatus 20 may be replace with or supplemented with a peeler plate.

In some embodiments, label securing apparatus 20 and/or container engaging feature/element 20 may, in part, maintain the desired orientation of container 32 or alter the orientation of container 32 to be place in the desired orientation. In a non-limiting example, maintaining the desired orientation of container 32 or altering the orientation of container 32 to be placed in the desired orientation may, in part, ensure repeatable label adherence in the preferred location on container 32 and/or promote efficient packaging techniques. In some embodiments, container 32 having one or more tear strips may be positioned on bottom conveyor 12 in a desired orientation and translating to at least partially engage with label securing apparatus 20. Container 32 may maintain the desired orientation upon disengagement with label securing apparatus 20. In other embodiments, container 32 having one or more tear strips may be positioned on bottom conveyor 12 in an undesired orientation and translating to at least partially engage with label securing apparatus 20. Container 32 may, upon disengagement with label securing apparatus 20, be positioned in a desired orientation. Label securing apparatus 20 may, in part, alter the orientation of container 32 to achieve the desired orientation. In some embodiments, the disclosed tear strip may act as a location feature for positioning container 32 in a desired orientation.

Label securing apparatus 20 may also be configured to self-align after at least partial engagement with container 32. Particularly, label securing apparatus 20 and/or container engaging feature/element 24, having at least partially engaged with a first container 32, may be configured to self-align so as to be placed in position to at least partially engage with a second container 32. In an exemplary embodiment, label securing apparatus 20 being at least partially rotatable and having at least two container engaging features/elements 24 may be configured and adapted to at least partially engage with a first container 32. Particularly, a first container engaging feature/element 24 may be configured and adapted to at least partially engage with the first container 32. Upon at least partial rotational movement of the first container 32, a second container engaging feature/element 24 may be positioned to at least partially engage with a second container 32. Label securing apparatus 20 may be sufficiently rotated in order to repeatably engage with container 32 in a desired position. For example, repeatably engaging container 32 with a corresponding container engaging feature/element 24.

Engagement with the second container 32 by the second container engaging feature/element 24 is not dependent on disengagement of the first container 32 by the first container engaging feature/element 24. However, it is appreciated that various labeling processes may be implemented which introduce various container 32 advancing speeds. Thus, in some embodiments, engagement with the second container 32 by the second container engaging feature/element 24 may, in part, be dependent on disengagement of the first container 32 by the first container engaging feature/element 24.

In some embodiments, container engaging feature/element 24 may be configured and dimensioned based on a desired container 32. Particularly, container engaging feature/element 24 may be configured and dimensioned to at least partially engage with a corresponding container 32. Container 32, having one or more shapes (e.g., sphere, cylinder, cone, cube, tetrahedron, triangular prism, pentagonal prism, hexagonal prism, octagonal prism, star prism, and any combination thereof), may at least partially interact with container engaging feature/element 24 having a corresponding shape. Container engaging feature/element 24 may be configured and dimensioned to at least partially engage with container 32 having similar dimensions. In one non-limiting example, the distance between first edge 28 and second edge 30 may be similar to the diameter of container 32. Furthermore, the radius of curved portion 26, defined by the plane defined by first edge 28 and second edge 30, may be similar to the radius of container 32.

In some embodiments, container labeling apparatus 10 may be configured to provide labels to at least two distinct container 32 shapes. In such instances, label securing apparatus 20 may include at least two container engaging features/elements 24, each container engaging feature/element 24 configured and adapted to at least partially engage with one of the two distinct container 32 shapes. The two distinct container engaging features/elements 24 may be positioned adjacent to each other. The two distinct container engaging features/elements 24 may be positioned opposite to each other.

In some embodiments, label securing apparatus 20 may be configured for passive movement, active movement, or partially passive movement and partially active movement. Particularly, label securing apparatus 20 being configured for active movement may include one or more drive mechanisms to control the rotational movement of label securing apparatus 20. The rotational movement may be aligned with the translational movement of conveyor 12, 14. Label securing apparatus 20 being configured for passive movement may freely rotate without one or more drive mechanisms. The rotational movement of passive label securing apparatus 20 may be determined, in part, by conveyor 12, 14. Thus, as a first container 32 engages with label securing apparatus 20, label securing apparatus 20 rotates a predetermined amount. In some instances, passive label securing apparatus 20 is configured to sufficiently rotate to engage with a second container 32 (e.g., self-align).

In other embodiments, container labeling apparatus 10 may include one or more sensors (e.g., positioning sensor, counting sensor, speed sensor, and any combinations thereof). For example, label securing apparatus 20 may include one or more sensors (e.g., positioning sensor, counting sensor, speed sensor, and any combinations thereof).

Although the present disclosure has been described with reference to exemplary implementations, the present disclosure is not limited by or to such exemplary implementations. Rather, various modifications, refinements and/or alternative implementations may be adopted without departing from the spirit or scope of the present disclosure.

The invention claimed is:

1. A side wrap labeling machine, comprising:

a container transport system for moving at least one container from an input end of the side wrap labeling machine to an output end, the container transport system including a top conveyor spaced apart from a bottom conveyor, wherein the top and bottom conveyors operate at the same speed and the spacing between the top and bottom conveyors is adjustable and set based on a height of the at least one container;

a label dispensing apparatus which dispenses at least one label and places the at least one label on a side of each container traversing the container transport system; and at least one rotatable label securing apparatus which includes at least one container engaging feature/element having a continuous surface which is shaped to correspond with the side of the container and affix the entire label thereto, the container engaging feature receiving the at least one container being driven to the output end by the top and bottom conveyors; wherein the rotatable securing apparatus is caused to rotate by the at least one container and upon rotation affix the label;

wherein the at least one rotatable label securing apparatus is positioned between the top conveyor and bottom conveyor and is configured to secure the container laterally and the label as they traverse the container transport system.

2. The side wrap labeling machine of claim 1, wherein the at least one rotatable label securing apparatus includes four container engaging features/elements.

3. The side wrap labeling machine of claim 1, wherein the at least one rotatable label securing apparatus defines a star wheel configuration.

4. The side wrap labeling machine of claim 1, wherein the at least one rotatable label securing apparatus includes first and second rotatable label securing apparatuses each having at least one container engaging feature/element.

5. The side wrap labeling machine of claim 4, wherein the second rotatable label securing apparatus is oppositely positioned from the first rotatable label securing apparatus and is configured to secure a second label.

6. The side wrap labeling machine of claim 4, wherein the first rotatable labeling securing apparatus and the second rotatable label securing apparatus rotate independently of each other.

7. The side wrap labeling machine of claim 1, wherein the at least one rotatable label securing apparatus is configured to secure up to a 180 degree label.

8. The side wrap labeling machine of claim 1, wherein the at least one rotatable label securing apparatus is configured to secure a first container traversing the container transport system and self-align in order to secure a second container traversing the container transport system a distance behind the first container.

9. The side wrap labeling machine of claim 1, wherein the at least one container engaging feature/element defines a curved surface.

10. The side wrap labeling machine of claim 9, wherein the curved surface of the at least one container engaging feature/element is dimensioned to secure a similarly dimensioned container.

11. A method of affixing at least one label to at least one container, the method comprising:

transporting the at least one container on a container transport system from an input end of a container labeling apparatus to an output end, the container transport system including a top conveyor spaced apart from a bottom conveyor, wherein the top and bottom conveyors travel at the same speed and the spacing between the top and bottom conveyors is adjustable and set based on a height of the at least one container;

dispensing and placing the at least one label on a side of each container traversing the container transport system using a label dispensing apparatus;

receiving the at least one container being driven to the output end by the top and bottom conveyors within an container engagement feature associated with a rotatable label securing apparatus;

rotating the rotatable securing apparatus by driving the at least one container using the top and bottom conveyors; and affixing the at least one label on the side of each container traversing the container transport system using the at least one rotatable label securing apparatus, wherein the at least one rotatable label securing apparatus is positioned between the top conveyor and the bottom conveyor.

12. The method of claim 11, wherein the at least one rotatable label securing apparatus is configured to secure a first container traversing the container transport system and self-align in order to secure a second container traversing the container transport system a distance behind the first container.

13. The method of claim 11, wherein the at least one rotatable label securing apparatus includes first and second rotatable label securing apparatuses each having at least one container engaging feature/element.

14. The method of claim 13, wherein the first rotatable label securing apparatus and the second rotatable label securing apparatus secure two labels to the side of the container.

15. The method of claim 13, wherein the first rotatable label securing apparatus and the second rotatable label securing apparatus rotate independently of each other.

16. The method of claim 13, wherein the first rotatable label securing apparatus and the second rotatable label securing apparatus are oppositely positioned from each other.

17. The method of claim 11, wherein the at least one rotatable label securing apparatus is configured for passive movement.

18. The method of claim 11, wherein the container traverses the container transport system tangential to the at least one rotatable label securing apparatus.

* * * * *